US010184627B2

(12) United States Patent
Wei

(10) Patent No.: US 10,184,627 B2
(45) Date of Patent: Jan. 22, 2019

(54) LED LAMP CONVENIENT TO SWITCH FLAME DIRECTION

(71) Applicant: MUMEDIA PHOTOELECTRIC LIMITED, Guangzhou, Guangdong (CN)

(72) Inventor: Ninghua Wei, Guangdong (CN)

(73) Assignee: MUMEDIA PHOTOELECTRIC LIMITED, Guangzhou (CN)

( * ) Notice: Subject to any disclaimer, the term of this patent is extended or adjusted under 35 U.S.C. 154(b) by 0 days.

(21) Appl. No.: 15/907,307

(22) Filed: Feb. 28, 2018

(65) Prior Publication Data

US 2018/0320848 A1 Nov. 8, 2018

(30) Foreign Application Priority Data

May 3, 2017 (CN) ..... 2017 2 0482552 U

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***F21S 10/04*** | (2006.01) |
| ***F21V 23/04*** | (2006.01) |
| ***H05B 33/08*** | (2006.01) |
| ***F21V 19/00*** | (2006.01) |
| *F21S 6/00* | (2006.01) |
| *F21Y 115/10* | (2016.01) |
| *F21Y 107/30* | (2016.01) |

(52) U.S. Cl.

CPC ..... *F21S 10/043* (2013.01); *F21V 19/0015* (2013.01); *F21V 23/04* (2013.01); *F21V 23/0492* (2013.01); *H05B 33/0845* (2013.01); *H05B 37/0281* (2013.01); *F21S 6/001* (2013.01); *F21Y 2107/30* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2006/0208666 | A1* | 9/2006 | Johnson | F21S 10/04 315/294 |
| 2008/0094825 | A1* | 4/2008 | Silver | F21S 6/001 362/161 |
| 2014/0286024 | A1* | 9/2014 | Li | F21S 10/04 362/392 |
| 2016/0327227 | A1* | 11/2016 | Green, Jr. | F21S 10/043 |

* cited by examiner

*Primary Examiner* — Anh Q Tran

(57) ABSTRACT

The invention relates to the field of lamps, specifically an LED lamp convenient to switch a flame direction. The LED lamp comprises a substrate, a circuit board with a control circuit, a diverter switch and lamp beads; wherein the lamp beads are arranged on the substrate; wherein the control circuit comprises an effect control circuit module connected with the lamp beads and outputting signals to control the on and off and brightness of the lamp beads in a predetermined time sequence, to simulate the flame effect; the diverter switch is connected with the effect control circuit module, to output the signals of different time sequences, thus simulating the flame effects of different status. The lamp of the invention provides an extremely realistic and interesting flame effect.

7 Claims, 4 Drawing Sheets

LED LAMP CONVENIENT TO SWITCH FLAME DIRECTION

CROSS-REFERENCE TO RELATED APPLICATIONS

This application claims the benefit of Chinese Utility Model Application No. 201720482552.X filed on May 3, 2017, the contents of which are incorporated herein by reference.

FIELD OF THE INVENTION

The invention relates to the field of lamps, specifically an LED lamp convenient to switch the flame direction.

BACKGROUND OF THE INVENTION

With the development of technology, LED is applicable to more and more occasions of multicolor illumination such as LED streetlights, courtyard lamps and various kinds of floodlights, which vivify the public squares, courtyards and the like, as different tones can bring different rendering effect to the surrounding environments.

Besides from the illuminating effect, some of the lamps have ornamental effect. Flame lamp is one of the lamps pursuing ornamental effect, which simulates jumping and flashing effect of burning flame. Traditional fire lamps use the quartz bulb to lighten, while the fan blows the red silk belt, thus simulating the burning flame as the quartz bulb shoots the light onto the swaying red silk belt. However, the fan brings much noise, while the silk belts easily malfunction, including twisting, knotting and being damaged.

The applicant has been engaged in technical development of LED flame lamps for years, and developed a series of LED flame lamps, although all of which have their flame direction un-switchable. The flame lamps will be more interesting and realistic if the flame direction can be automatically switched when the lamp is inverted.

SUMMARY OF THE INVENTION

The invention aims to provide an LED lamp convenient to switch the flame direction.

In order to realize the purpose of the invention, the LED lamp of the invention comprises a substrate, a circuit board with a control circuit, a diverter switch and lamp beads; wherein the lamp beads are arranged on the substrate; wherein the control circuit comprises an effect control circuit module connected with the lamp beads and outputting signals to control the on and off and brightness of the lamp beads according to a predetermined time sequence, to simulate the flame effect; the diverter switch is connected with the effect control circuit module, to output signals of different time sequences, thus simulating the flame effects of different status.

Preferably, the substrate is a curved flexible circuit board, the substrate can be cylindrical. Lamp beads are arranged on the exterior surface of the substrate.

Preferably, the effect control circuit module comprises a first effect control module for simulating an effect of a forward flame, and a second effect control module for simulating an effect of a reverse flame; and the diverter switch is connected with the first effect control module and the second effect control module.

Preferably, the diverter switch is a gravity-sensing switch.

Preferably, one end of each lamp bead is connected with one I/O terminal of the effect control circuit module, and the other end is connected with a constant-voltage power source.

Preferably, the effect control circuit module and the diverter switch are connected with the constant-voltage power source.

Preferably, the lamp beads are arranged in a staggered array on the substrate, which is that the lamp bead in the next row is laterally arranged between two adjacent lamp beads in the previous row.

Preferably, the effect control circuit module comprises a Cortex's N76E003 chip, which is connected with the constant-voltage power source to form a small N76E003 chip system, thus simulating the PWM to control the on and off and brightness of the lamp beads. The RST pin of the N76E003 chip is connected with the diverter switch and a current-limiting resistance, wherein the other end of the current-limiting resistance is connected with the positive pole of the constant-voltage power source, and the other end of the diverter switch is earthed. The electrical level of the RST pin can be changed between a high level and a low level when the diverter switch is switched; the AIN pin of the N76E003 chip is connected in series with the divider resistance and then connected with the positive pole of the constant-voltage power source, and is connected with a slide rheostat and a tact switch which are connected in parallel before being earthed. The GND pin of the N76E003 chip is earthed, the VDD pin is connected with the positive pole of the constant-voltage power source, a capacitance is connected between the GND pin and the VDD pin; the remaining pins of the N76E003 chip can be connected with the lamp beads and output analog PWM signals or high-low level signals, as to control the on and off and brightness of the lamp beads. All I/O pins of the N76E003 chip have same functions and thus can be exchanged with each other. The above description of the pins should not be considered as limiting the scope of the invention.

Preferably, a lamp housing covering the substrate from outside is further provided, a handle is connected with the lower end of the lamp housing, the handle is arranged with a master switch; and the master switch is connected in series with the output terminal of the constant-voltage power source.

By means of the diverter switch which can be switched to output signals for different time sequences, simulated flames of different status can be obtained by the LED lamp of the invention. Particularly, when the diverter switch is the gravity-sensing switch, the inverted lamp can automatically display an effect of a reverse flame, which is extremely realistic and interesting. As the Cortex's N76E003 chip is used for simulating the PWM to control the on and off and brightness of the lamp, the circuit can be maximally simplified. The lamp beads are correspondingly connected with the I/O terminals of the effect control circuit module in one-to-one correspondence. Compared with traditional configurations in which the lamp beads are lightened in a manner of being scanned by rows and columns, the frequency is reduced and the energy consumption is lowered, and the battery life can be improved as well.

DETAILED DESCRIPTION OF ILLUSTRATED EMBODIMENTS

The preferred embodiments of the invention are further illustrated in conjunction with the drawings.

Figure 1:
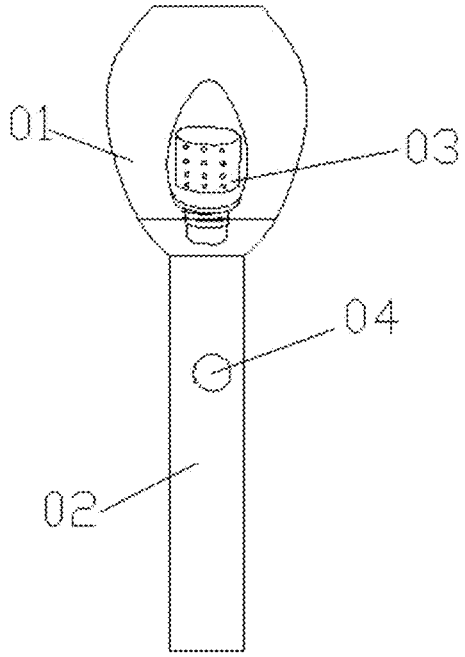
FIG. 1 is a structural schematic diagram of an LED lamp mounted with a lamp housing and a handle.

As illustrated in FIG. 1, an LED lamp comprises a lamp housing 01 which covers a substrate 03 from outside, a handle 02 is connected with a lower end of the lamp housing, the handle is provided with a master switch 04; and the master switch is connected in series with an output terminal of a constant-voltage power source.

Figure 2:
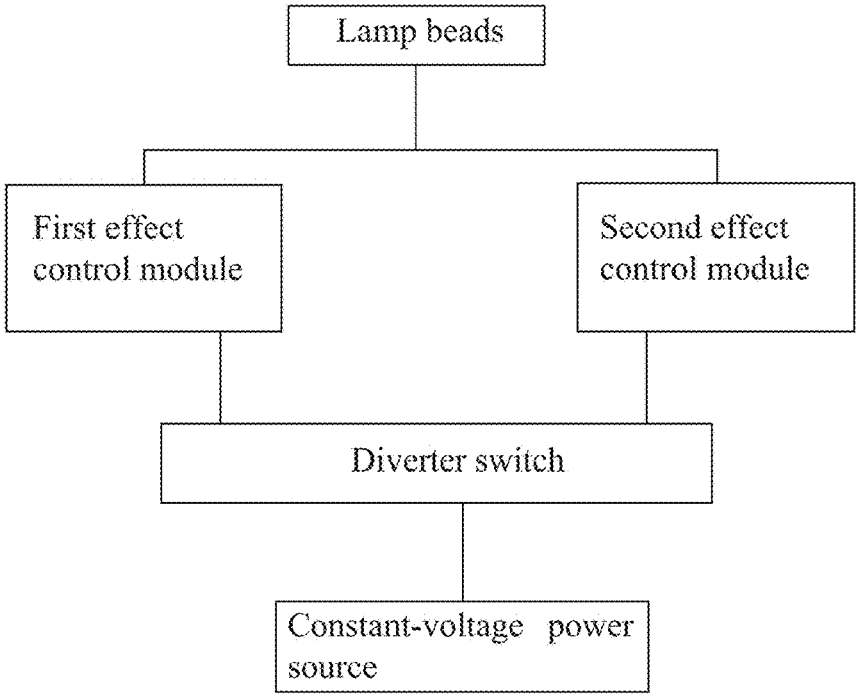
FIG. 2 is a schematic circuit diagram of an LED lamp.

The LED lamp comprises the substrate, a circuit board with a control circuit, a diverter switch and lamp beads. The lamp beads are arranged on the substrate. The control circuit comprises an effect control circuit module connected with the lamp beads and outputting signals to control the on and off and brightness of the lamp beads according to a predetermined time sequence, to simulate the flame effect. The diverter switch is connected with the effect control circuit module, to output the signals for different time sequences, thus simulating the flame effect of different status. The substrate is a curved and cylindrical flexible circuit board. The lamp beads are arranged on the exterior surface of the substrate. The effect control circuit module comprises a first effect control module for simulating an effect of a forward flame, and a second effect control module for simulating an effect of a reverse flame. The diverter switch is a gravity-sensing switch connected with the first effect control module and the second effect control module. The schematic circuit diagram is illustrated in FIG. 2: the diverter switch is connected with the first effect control module, the second effect control module and the constant-voltage power source; and the first effect control module and the second effect control module are respectively connected with the lamp beads.

Figure 3:
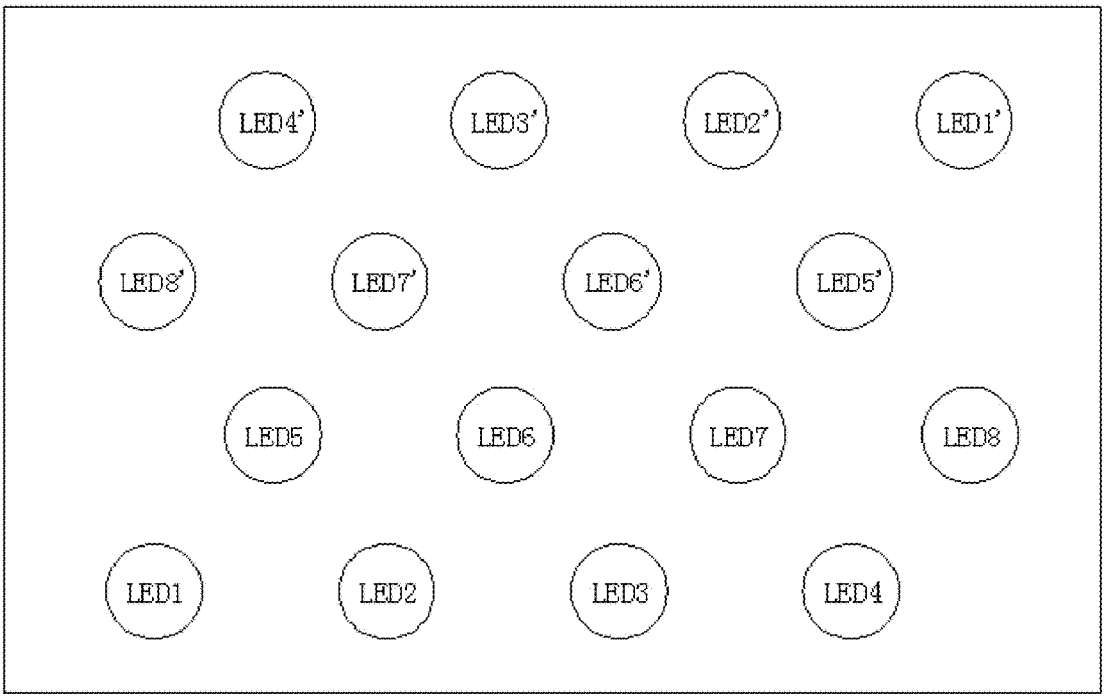
FIG. 3 is a structural schematic diagram illustrating an unfolded substrate.

The lamp beads comprise at least 12 lamp beads of 3 rows and 4 columns. The higher the lamp beads density and the greater the number of the lam beads, the more realistic the flame effect is, but also the manufacturing cost will increase. The 3D flame effect should ensure that the lamp beads of at least 3 rows and 3 columns are visible from any direction. In fact, the flame effect obtained from lamp beads of 3 rows and 4 columns is already considerably distorted. The realistic flame effect can be obtained only when the number of lamp beads is no less than 16 in 4 rows and 4 columns. As illustrated in FIG. 3, the substrate comprises LED1-8 and LED1'-8', totally 16 lamp beads.

Figure 4:
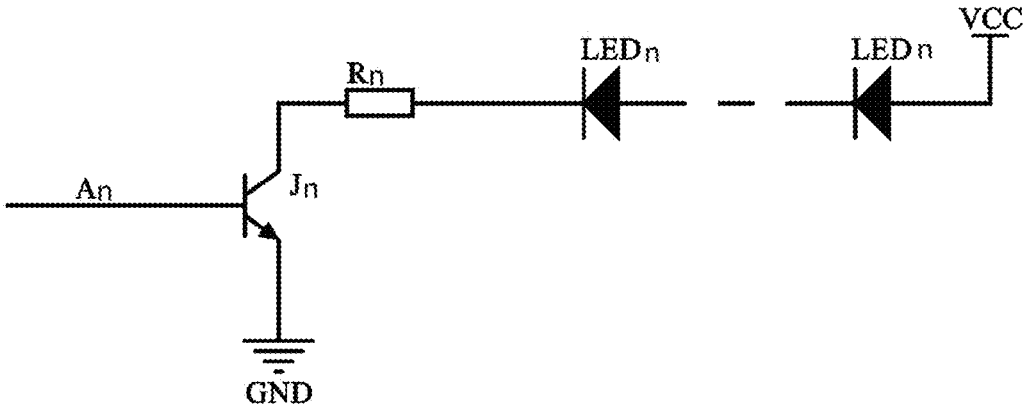
FIG. 4 and FIG. 5 are schematic wiring diagrams of lamp beads arranged on a substrate.
Figure 5:
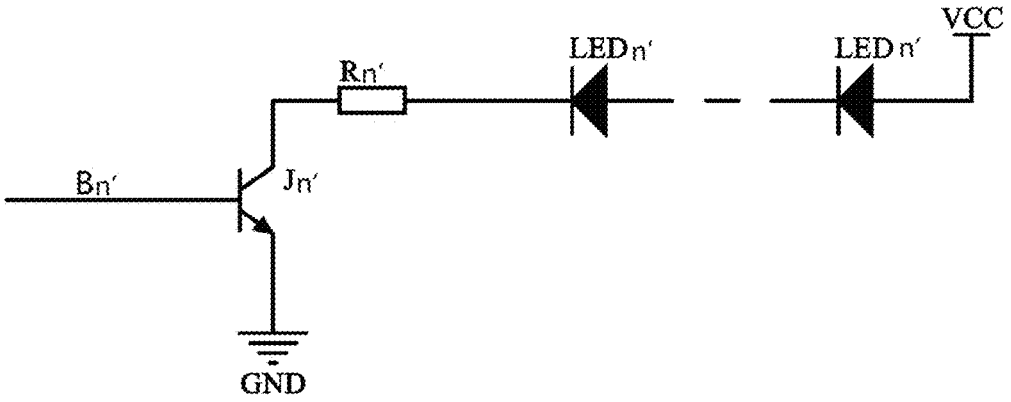
Figure 6:
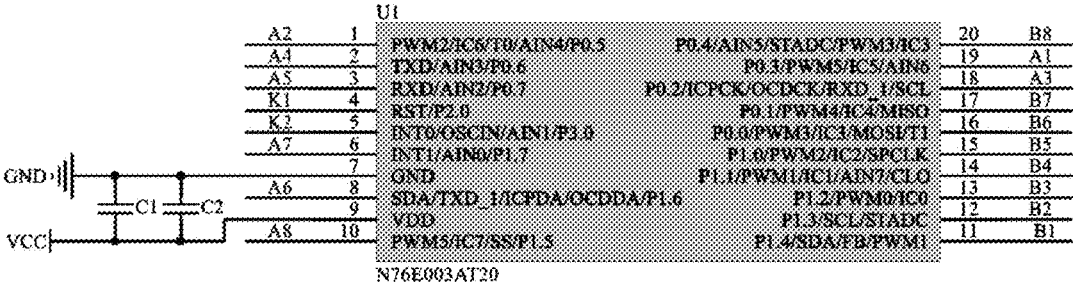
FIG. 6 is a schematic wiring diagram of an effect control circuit module.

FIG. 4 and FIG. 5 are schematic wiring diagrams of the lamp beads arranged on the substrate. FIG. 6 is a schematic wiring diagram of the effect control circuit module. One end of the lamp bead LEDn (LEDn') is connected with the positive pole of the constant-voltage power source, and the other end is connected in series with the current-limiting resistance Rn (Rn'), and then is connected with the collector of the triode Jn (Jn'). The base An (Bn') of the triode is connected with the corresponding I/O pin of N76E003 chip (U1). The emitter of the triode is earthed. The N76E003 chip is connected with the constant-voltage power source to form a small N76E003 chip system, thus simulating the PWM to control the on and off and brightness of the lamp beads. The GND pin of the N76E003 chip is earthed, the VDD pin is connected with the positive pole of the constant-voltage power source, capacitances C1 and C2 are connected between the GND pin and the VDD pin. The remaining pins of the N76E003 chip can be connected with the lamp beads and output the analog PWM signals or high-low level signals, as to control the on and off and brightness of the lamp beads.

Figure 7:
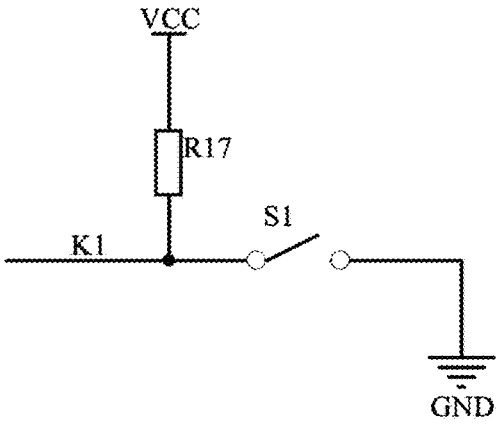
FIG. 7 is a schematic wiring diagram of a gravity-sensing switch.
Figure 8:
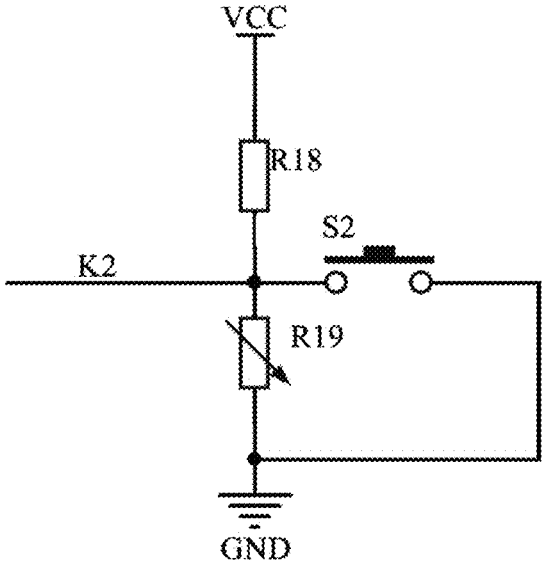
FIG. 8 is a schematic wiring diagram of a tact switch.

As illustrated in FIG. 7, the RST pin (K1) of the N76E003 chip is connected with the gravity-sensing switch S1 and the current-limiting resistance R17, wherein the other end of the current-limiting resistance is connected with the positive pole of the constant-voltage power source, and the other end of the gravity-sensing switch S1 is earthed. The electrical level of the RST pin can be high level or low level when the gravity-sensing switch is forward or inverted. As illustrated in FIG. 8, the AIN pin (K2) of the N76E003 chip is connected in series with the divider resistance R18 and then connected with the positive pole of the constant-voltage power source, and is connected with the slide rheostat R19 and the tact switch S2 which are connected in parallel before being earthed. The tact switch S2 is mounted on the handle and is used to switch on or switch off the LED lamp.

The invention claimed is:

1. An LED lamp convenient to switch a flame direction, characterized in that: it comprises a substrate (03), a circuit board with a control circuit, a diverter switch and lamp beads; wherein the lamp beads are arranged on the substrate (03); wherein the control circuit comprises an effect control circuit module connected with the lamp beads and outputting a signal for achieving a on and off control and a brightness control of the lamp beads according to a predetermined time sequence, to simulate a flame effect; the diverter switch is connected with the effect control circuit module to output signals for different time sequences to achieve flame effects of different status;

the effect control circuit module comprises a microprocessor chip, which is connected with a constant-voltage power source to form a small microprocessor chip system, to enable a PWM simulation to achieve the on and off control and the brightness control of the lamp beads;

an RST pin (K1) of the Microprocessor chip (U1) is connected with the diverter switch (S1) and a current-limiting resistance (R17), wherein the other end of the current-limiting resistance (R17) is connected with a positive pole of the constant-voltage power source, and the other end of the diverter switch (S1) is earthed; an electrical level of the RST pin (K1) is changed between a high level and a low level when the diverter switch (S1) is switched; an MN pin (K2) of the Microprocessor chip (U1) is connected in series with a divider resistance (R18) and then connected with the positive pole of the constant-voltage power source, and is connected with a slide rheostat (R19) and a tact switch (S2) which are connected in parallel and then being earthed; a GND pin of the Microprocessor chip (U1) is earthed, a VDD pin is connected with the positive pole of the constant-voltage power source, a capacitance is connected between the GND pin and the VDD pin; the remaining pins of the Microprocessor chip (U1) are connected with the lamp beads and output an analog PWM signal or high-low level signal, as to achieve the on and off control and the brightness control of the lamp beads.

2. The LED lamp convenient to switch the flame direction according to claim 1, characterized in that: the diverter switch is a gravity sensinggravity switch (S1).

3. The LED lamp convenient to switch the flame direction according to claim 1, characterized in that: the effect control circuit module comprises a first effect control module for simulating an effect of a forward flame, and a second effect control module for simulating an effect of a reverse flame; and the diverter switch is connected with the first effect control module and the second effect control module.

4. The LED lamp convenient to switch the flame direction according to claim 1, characterized in that: the substrate (03) is a cylindrical flexible circuit board, and the lamp beads are arranged on an exterior surface of the substrate (03).

5. The LED lamp convenient to switch the flame direction according to claim 1, characterized in that: the lamp beads are arranged in a staggered array on the substrate (03), which is that an lamp bead in a next row is laterally arranged between two adjacent lamp beads in a previous row.

6. The LED lamp convenient to switch the flame direction according to claim 1, characterized in that: one end of each lamp bead is connected with one I/O terminal of the effect control circuit module, and the other end is connected with a constant-voltage power source.

7. The LED lamp convenient to switch the flame direction according to claim 1, characterized in that: it further comprises a lamp housing (01) which covers the substrate (03) from outside, a handle (02) is connected with a lower end of the lamp housing (01), the handle (02) is arranged with a master switch (04); and the master switch (04) is connected in series with an output terminal of a constant-voltage power source.

* * * * *